US007464934B2

(12) United States Patent
Schwartz

(10) Patent No.: US 7,464,934 B2
(45) Date of Patent: Dec. 16, 2008

(54) METHOD OF PLAYING GAME

(76) Inventor: Andrew Schwartz, 10787 Missouri Ave., #303, Los Angeles, CA (US) 90025

( * ) Notice: Subject to any disclaimer, the term of this patent is extended or adjusted under 35 U.S.C. 154(b) by 213 days.

(21) Appl. No.: 10/798,738

(22) Filed: Mar. 10, 2004

(65) Prior Publication Data

US 2004/0178580 A1 Sep. 16, 2004

Related U.S. Application Data

(60) Provisional application No. 60/453,933, filed on Mar. 10, 2003.

(51) Int. Cl.
*A63F 3/08* (2006.01)
*A63F 3/00* (2006.01)

(52) U.S. Cl. ..... 273/274; 273/236; 273/243

(58) Field of Classification Search ..... 273/236, 273/242, 243, 274, 248, 253–255
See application file for complete search history.

(56) References Cited

U.S. PATENT DOCUMENTS

| | | | | | |
|---|---|---|---|---|---|
| 1,584,668 | A | * | 5/1926 | Sjogren | 273/255 |
| 2,831,690 | A | * | 4/1958 | Seay | 273/254 |
| 3,645,531 | A | | 2/1972 | Wright | |
| 4,059,276 | A | * | 11/1977 | Weniger | 273/243 |
| 4,070,026 | A | * | 1/1978 | Cambardella | 273/254 |
| 4,129,304 | A | * | 12/1978 | Mager | 273/243 |
| 4,334,685 | A | | 6/1982 | Robbins et al. | |
| 4,813,678 | A | * | 3/1989 | Collazo et al. | 273/243 |
| 4,953,873 | A | * | 9/1990 | Jacobson | 273/274 |
| 5,085,441 | A | * | 2/1992 | Jova | 273/248 |
| 5,135,231 | A | * | 8/1992 | Piper | 273/254 |
| 5,156,406 | A | * | 10/1992 | Johnson et al. | 273/248 |
| 5,607,159 | A | * | 3/1997 | Bryson | 273/243 |
| 5,743,798 | A | | 4/1998 | Adams et al. | 463/17 |
| 5,823,872 | A | | 10/1998 | Prather et al. | |
| 6,059,659 | A | | 5/2000 | Busch et al. | 463/17 |
| 6,186,505 | B1 | * | 2/2001 | Perrie et al. | 273/274 |
| 6,520,502 | B1 | * | 2/2003 | Drouhard | 273/242 |
| 7,080,838 | B2 | * | 7/2006 | Cohen | 273/274 |

FOREIGN PATENT DOCUMENTS

GB 2133992 8/1984

OTHER PUBLICATIONS

Mosteller, Frederick; "Fifty Challenging Problems in Probability with Solutions," (1965) (relevant excerpts), Dover Publications, New York, New York, USA.

Gardner, Martin; "Aha, Insight!," (1978) (relevant excerpts), W.H. Freeman & Company, USA.

* cited by examiner

*Primary Examiner*—Gene Kim
*Assistant Examiner*—Alyssa M Hylinski
(74) *Attorney, Agent, or Firm*—Cislo & Thomas LLP; Kelly W. Cunningham, Esq.

(57) ABSTRACT

A board game and methods of playing a board game are described herein. The board game involves the movement of a game piece based upon the generation of a random number. The game piece is moved until the movement causes a win or loss scenario, which may be conducive to gambling and making wagers. During the movement of the game piece, the bank may inchoately match the player's wager. The inchoate "cargo" excites, tempts, and entices the players to wager and increase player involvement.

19 Claims, 8 Drawing Sheets

METHOD OF PLAYING GAME

CROSS-REFERENCES TO RELATED APPLICATIONS

This patent application claims the benefit of U.S. Provisional Patent Application No. 60/453,933 filed Mar. 10, 2003, which is hereby incorporated by reference.

BACKGROUND

Many casino games are readily available both in casinos and in stores for purchase and home use. These games may have very simple rules, such as slot machines and keno, or may have relatively complicated rules, such as craps. These games also may focus on individual play, such as blackjack and slot machines, or focus on a group participation or look and feel, such as craps and roulette.

While numerous games are widely available today and successful, there remains a need for a game that involves the excitement and energy of a group participation game that is more inviting for gamblers or beginners of all skill levels. Furthermore, there needs to be a game that can introduce any gambler or beginner of any skill level to any game, whether it be an existing game, such as craps and roulette, or a future game not as of yet invented.

SUMMARY

Embodiments disclosed herein are directed to a board game involving the movement of a game piece based upon the generation of a random number or array of numbers. According to various embodiments, the random number(s) may be generated by the roll of a die, the spin of a roulette wheel, the draw of a card from a deck of cards, or the like. The game piece may be repeatedly moved until the movement causes a win or a loss scenario, which may be conducive to gambling and making wagers.

In one embodiment, a board game includes a game piece that is moved from a starting point in stepwise increments along one of n directions. After each incremental movement of the game piece, the position on which the game piece lands dictates whether there will be another roll or draw repeating the steps above, or whether the game, or the present round of the game, is concluded. If the game or round is concluded, then the final position of the game piece may also indicate whether the game or round was concluded "positively" or "negatively."

Also, in one embodiment of the invention, if the game is on going and there is to be another roll or draw, then the position of the game piece may also initiate a secondary event, such as a doubling or splitting option or other game-related benefit to or decision for the participants. Once a round is concluded, a new round may commence following the same rules as described above for further wagering and game playing.

DETAILED DESCRIPTION

The detailed description set forth below in connection with the appended drawings is intended as a description of exemplary embodiments and is not intended to represent the only forms in which these embodiments may be constructed and/or utilized. The description sets forth the functions and the sequence of steps for operating the embodiments. However, it is to be understood that the same or equivalent functions and sequences may be accomplished by different embodiments that are also intended to be encompassed within the spirit and scope of the specification.

Definitions

The term "absorbent" point as used herein refers to positions on the game board that represent end of the game. An "absorbent" point may be designated as "winning" or "safe" points or "losing" or "sink" points. The term "nonabsorbent" point as used herein refers to interim positions on the game board.

The term "random number" as used herein refers to a numerical value, selected from a predetermined set of values, a symbol selected from a set of symbols such as, but not limited to a numeral, a letter, a suit, such as clubs, spades, diamonds, and hearts, a direction such as, but not limited to, north, south, east and west. A random number generator includes a roll of a die or a pair of dice, a draw of one or more cards from a deck of cards, a coin toss, a spin of a roulette wheel or similar wheel, a gambling event, a sporting event, a meteorological event, or other such previously agreed to random event or gaming implements for generating a random event.

The term "inchoate" or "inchoate cargo" as used herein refers to contingent winnings that player may win depending upon their initial wager and the status of the game board at the end of a game or round.

Figure 1:
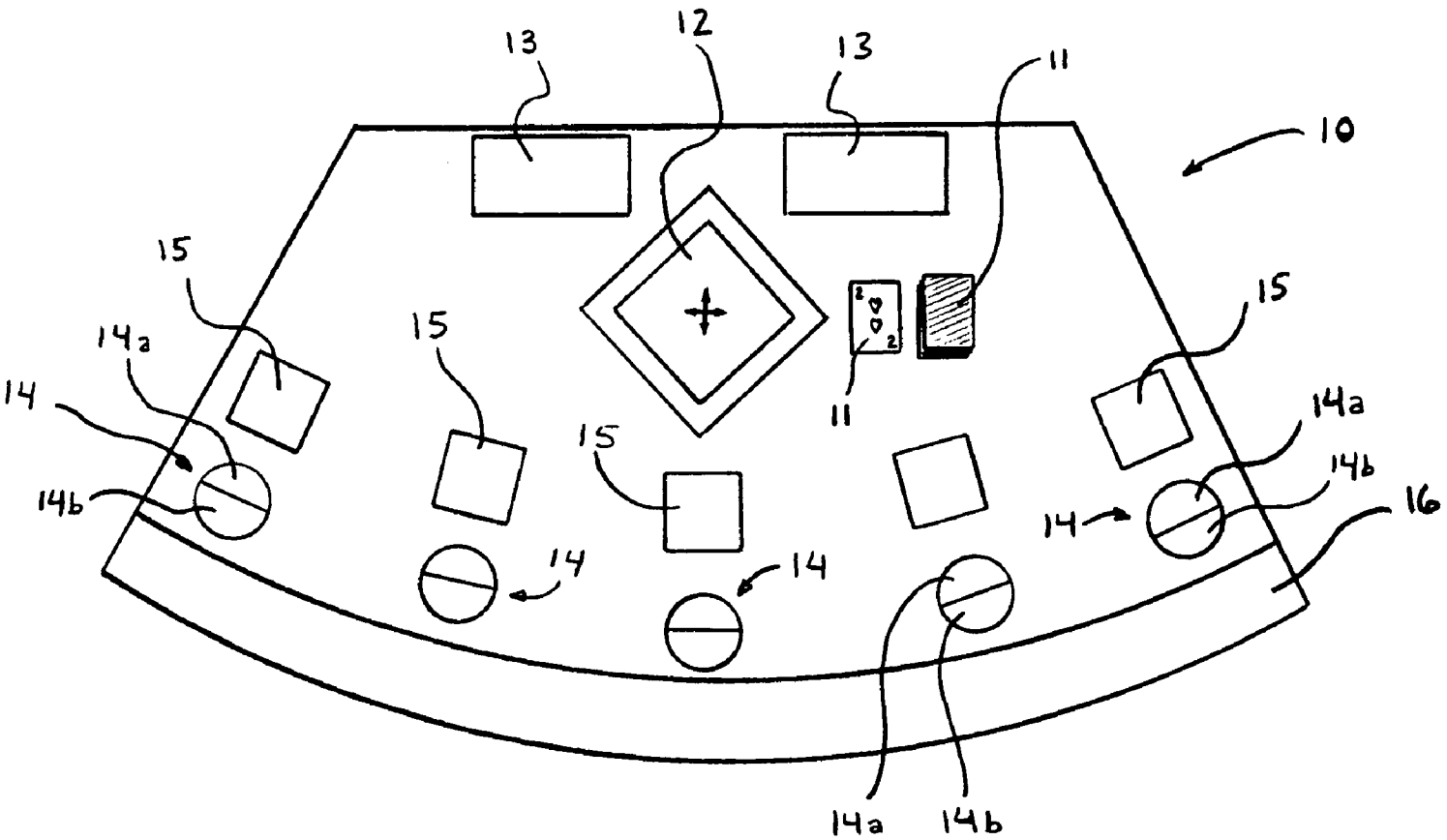
FIG. 1 is a top view of one embodiment of a game table in keeping with the present invention.

Turning now to the Figures, FIG. 1 illustrates one embodiment of a game table 10. The game table 10 includes a game board 12 and a random number generator 11. The game table 10 also includes a plurality of player positions 14 that are spaced along the periphery of the table 10, a position for a dealer, and the bank chips 13. The game table 10 includes a plurality of positions 15 where the individual players' pots or inchoate cargo is placed after each move on the game board 12. The table 10 may also include a plurality of positions 16 for each players' chips. The player positions 14, in one embodiment, may be composed of at least a "sink or swim" bet region 14*a*. In another embodiment, the betting position 14 may be composed of at least a "safe or edge" bet region 14*b*. As those skilled in the art will appreciate, the overall configuration of the game table 10 may be altered from what is depicted in FIG. 1.

Figure 2:
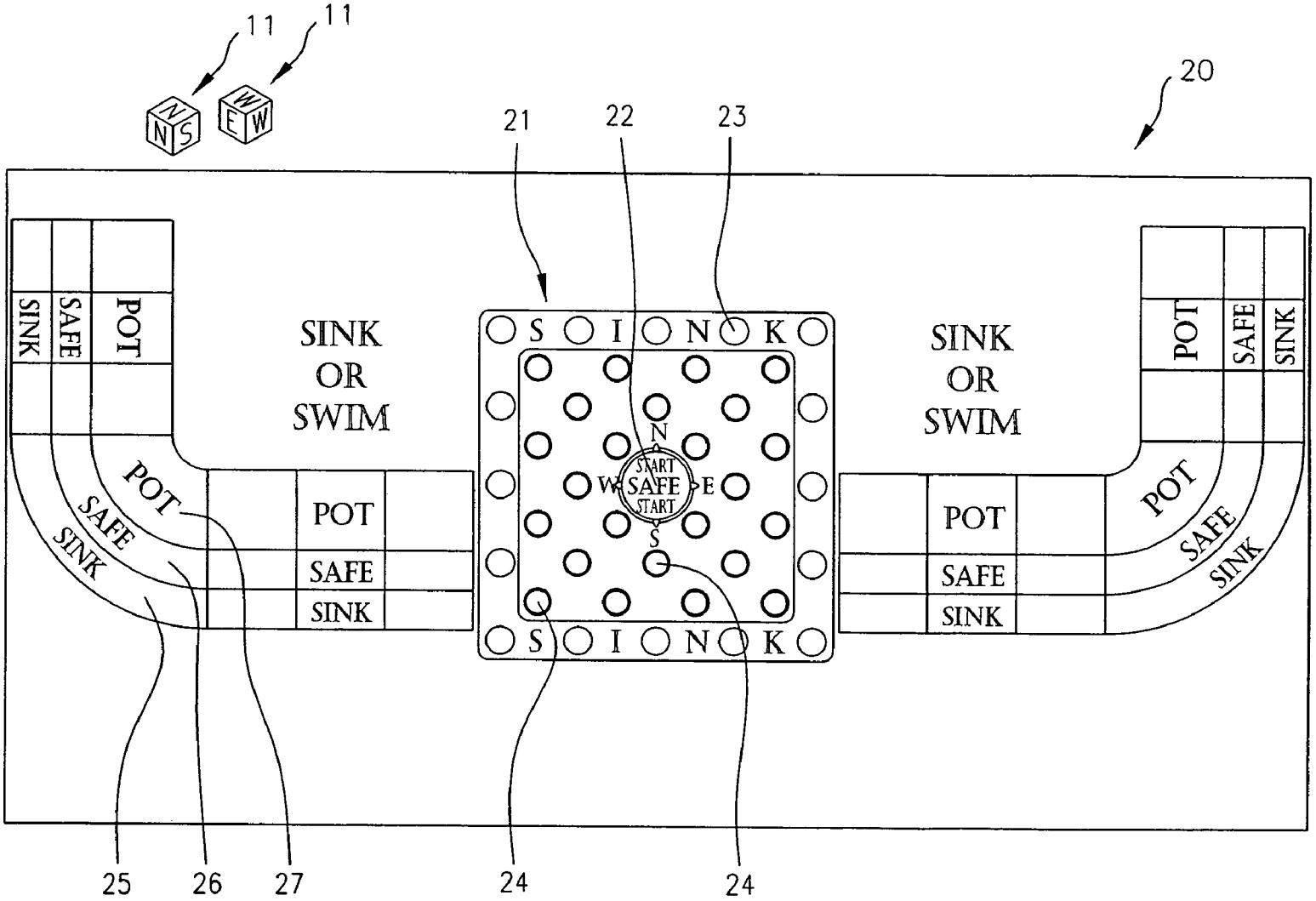
FIG. 2 is a top view of another embodiment of a game table.

FIG. 2 illustrates another embodiment of a game table 20. This game table 20 has dimensions similar to a craps table. The game board 21 may be a generally rectangular or square surface. The game board 21 includes a plurality of absorbent points 23 and non-absorbent points 24. The game table 20 also includes a plurality of betting stations 25, 26 spaced about the perimeter of the gaming table 20. The table 20 may also include individualized positions 27 where the player's pot or inchoate cargo is positionable on the table 20. The game board 21 also includes a starting point 22. As shown in FIG. 2, the starting point 22 is at the center of the game board 21. In the embodiment depicted in FIG. 2, the non-absorbent points 24 are positioned around the starting point 22 in a grid-like manner. The absorbent points 23 are positioned about the non-absorbent points 24. As shown in FIG. 2, the absorbent points 23 are positioned around the perimeter of the game board 21.

Figure 3:
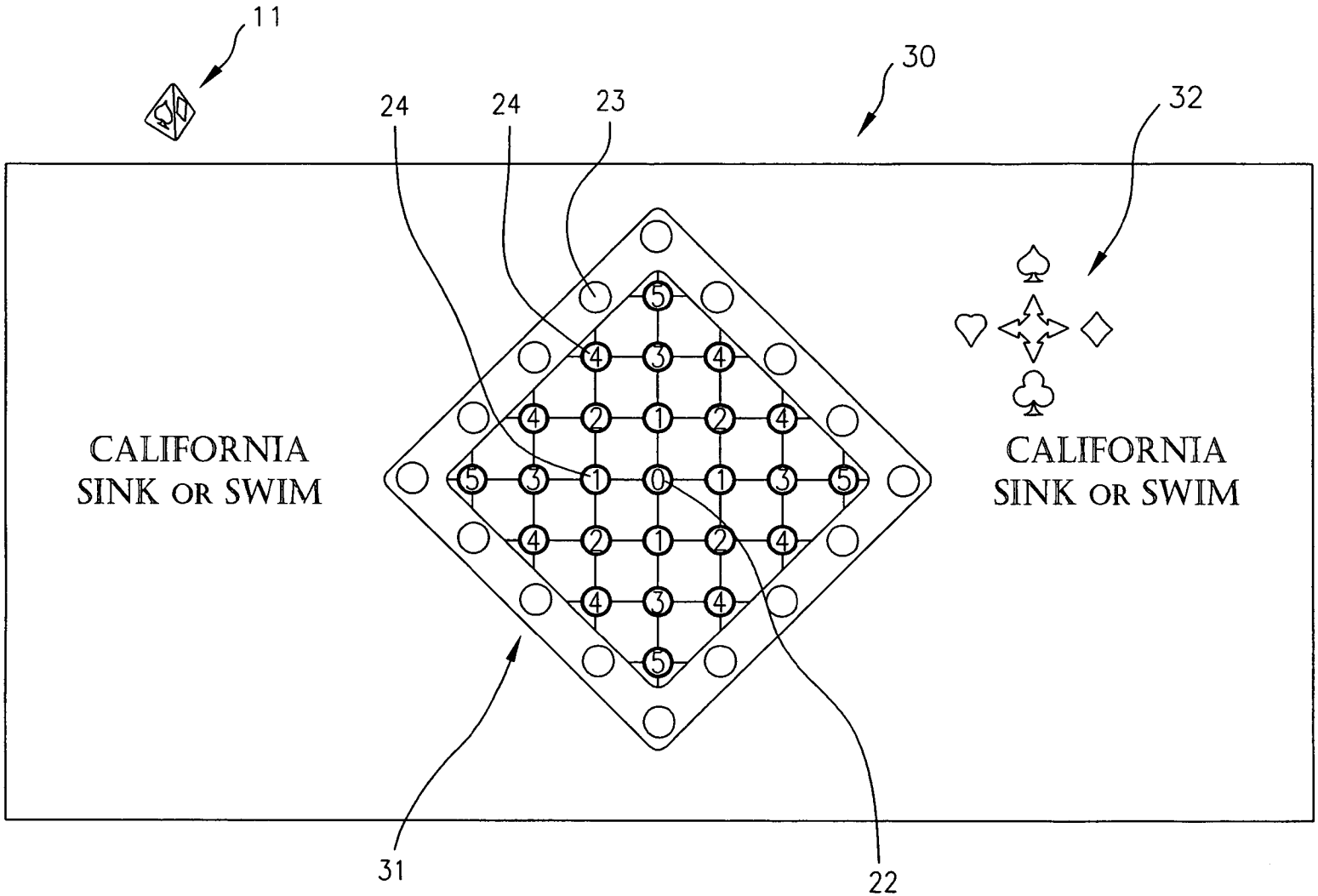
FIG. 3 is a top view of one embodiment of a game board in keeping with the present invention.

Turning now to FIG. 3, the game board 30 includes a gaming surface 31 and a directional indicator 32. The gaming surface 31 is similar to the gaming surface as depicted in FIG. 2 except the same surface 31 has a generally diamond shape. The board 30 includes a starting point 22 and a plurality of non-absorbent points 24, and a plurality of absorbent points 23. The non-absorbent points 24 are positioned around the starting point 22 in a grid like manner. In one embodiment, the non-absorbent points 24 may also include indicators that correspond to values assigned by the random number generator 11, or that correspond to the odds or probability that the game piece will land on the individual non-absorbent point 24. The game board 31 also includes a plurality of absorbent points 23 that are positioned around the perimeter of the game board 31. According to one embodiment, the absorbent points 22, 23 are designated as starting and ending points, respectively.

Figure 4:
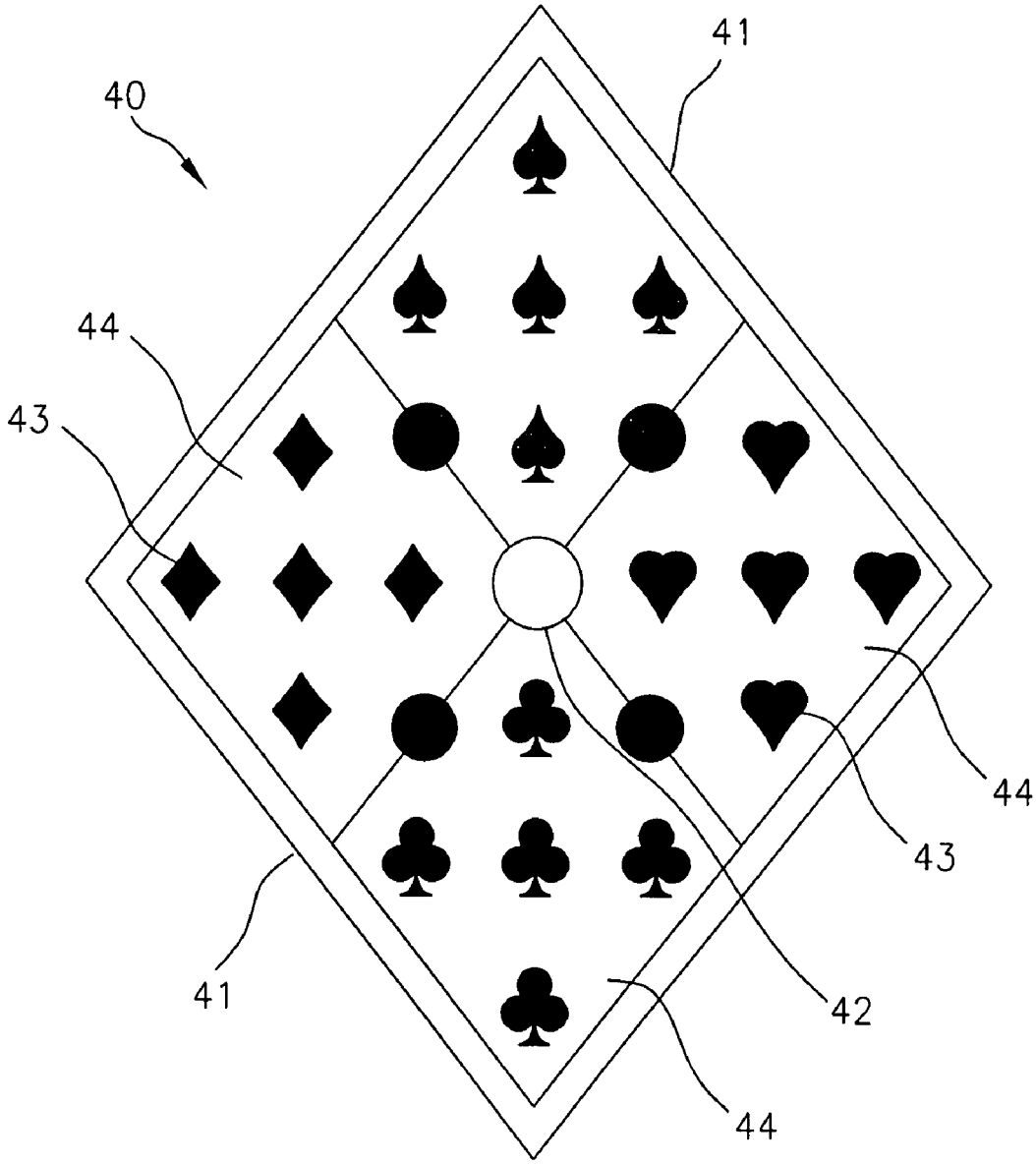
FIG. 4 is a top view of another embodiment of a game board.

FIG. 4 is another embodiment of the game board 40 having a generally diamond shape. In one embodiment, the game board may be divided into four quadrants 44. As shown in FIG. 4, the four quadrants correspond to the different suits of a deck. That is, the four quadrants 44 correspond to diamonds, clubs, spades, and hearts. Those skilled in the art will appreciate, the identifying markers for each quadrant may be altered from what is depicted in FIG. 4. The game board 40 also includes a plurality of absorbent points 41 which are positioned about the perimeter of the game board. The game board also includes a centrally positioned starting point 42. Like other embodiments described herein, the game board 40 also includes a plurality of non-absorbent 43 positioned around the starting point 42 in a grid like fashion.

Figure 5:
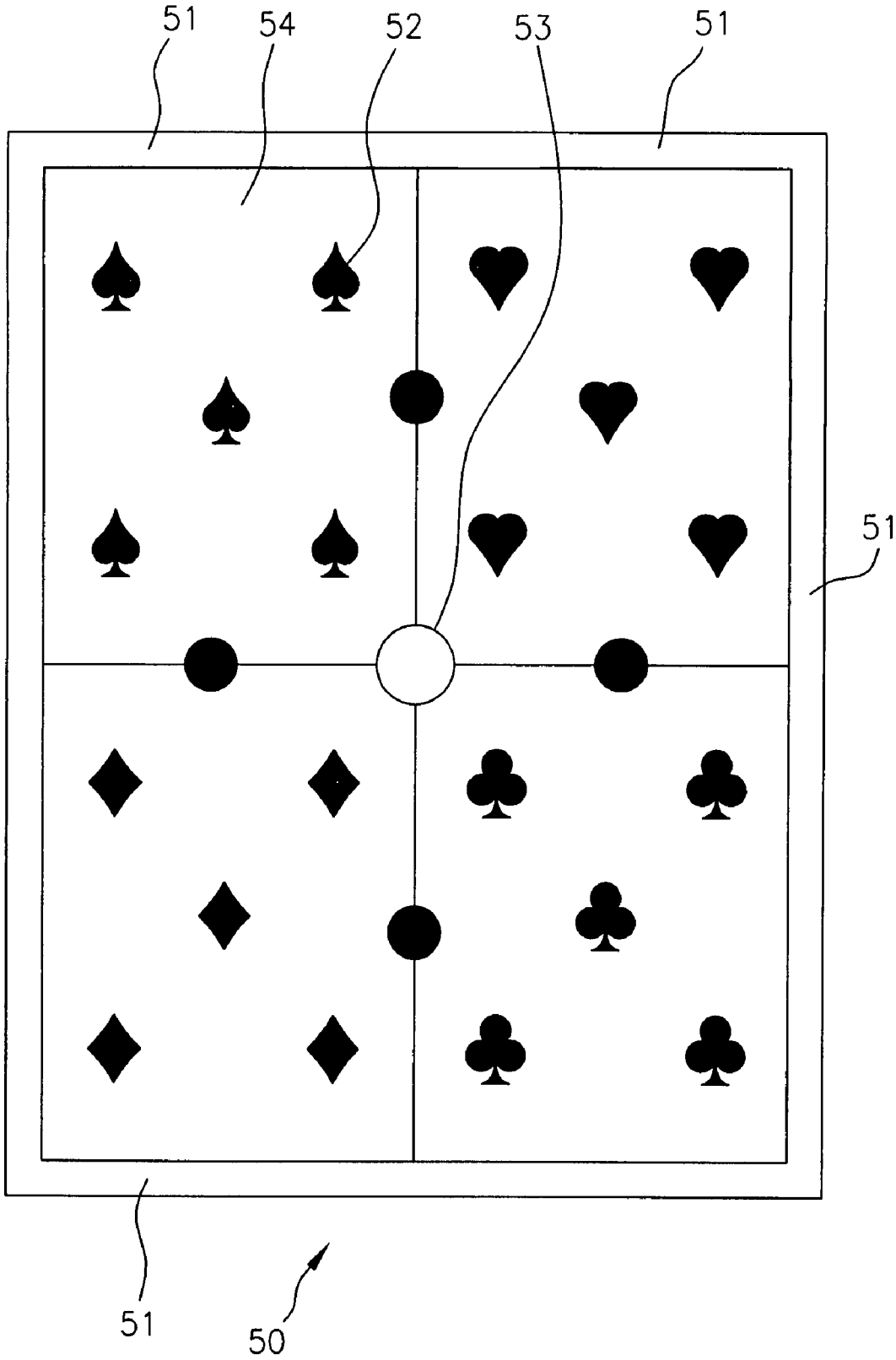
FIG. 5 is a top view of another embodiment of the game board.

FIG. 5 illustrates yet another embodiment of the game board 50 having a generally square-shaped playing surface. In one embodiment, the game board 50 may be divided into four equally sized quadrants 54. In one embodiment, the quadrants represent each of the card suits in a standard playing deck. The game board 50 includes a starting point 53 a plurality of non-absorbent points 52. The non-absorbent points 52 may be positioned around a starting point in a grid-like manner. The game board 50 also includes a plurality of absorbent points 51 that are positioned about the perimeter of the game board 50. As shown in FIG. 5, the non-absorbent points 52 within each quadrant represent different suits of a deck. In another embodiment, the game board 50 may be a single quadrant. That is, the game board 50 is not sub-divided into four quadrants.

The operation of the game or the game methodology in one embodiment of the present invention is composed of at least three different formulations:

Formulation One

1. Start
2. Determine next state with transition probabilities
3. Determine if state is nonabsorbent
4. If yes, then go to step 2 (repeating the process)
5. If no, then game ends Formulation Two 1. Start
2. Determine next state with transition probabilities
3. Determine if state is absorbing
4. If yes, then game ends
5. If no, then go to step 2 (repeating the process)

Formulation Three

1. Start
2. Determine if state is absorbing
3. If yes, then game ends
4. If no, then determine next state with transition probabilities
5. Go to step 2 (repeating the process)

As those skilled in the art will appreciate, these three formulations may be substantially equivalent.

Although there are many different applications using only minor permutations, in various embodiments of the game, one or more players play a series of rounds making wagers at each round based on the probabilities of a "win," a "loss," or "continuation." The rules of the game are kept simple so as to be as inviting as possible to players of all persuasions, not just the studied gambler.

The game is laid out in FIGS. 1, 2, and 3 on a table that has a game board region, but this is not a requirement. Note a game board is not necessary for play but is used as a player convenience. Abstract representation of the game board can be utilized instead of a physical board. For example, cards can be placed on discard piles face up corresponding to suit. Game ends based on the relative sizes of the discard piles. Another example is weights added (or subtracted) to a scale (or set of scales), such that when the scale(s) reads even (or in balance) game starts or ends safely and when it reads at an extreme point(s), game ends.

In one embodiment, the game board region is broken up into discrete sections similar to a chessboard. In another embodiment, the game board region is provided with a plurality of discrete positions, and a game piece that moves from one section or point to another as the game progresses. One or more point(s) are designated as the starting point, and one or more positions are designated as end points.

The player or players place bets on whether the game piece will move to a "winning" end point or a "losing" end point. According to various methods, one player or a player with the assistance of a "dealer" or a "bank," or a dealer himself operate a random number generator such as, but not limited to, a deck of cards, a pair of dice or single die, a sporting event, a horse race, a weather or meteorological event, or a roulette wheel. Based on the random number (or combination of random numbers) that is generated, the game piece is moved to one of the discrete positions.

This process is repeated with a new random number and a corresponding new move of the game piece, and repeated again until the game piece lands on an absorbent point. When the game piece lands on an absorbent point, the wagers are tallied and the players that bet on the correct type of absorbent point, i.e., "safe" instead of "sink," for example, win the bet, and those that bet on the wrong type of absorbent point lose their bet.

In another embodiment, the bank inchoately matches each player's bet after each move, except for the final move for players who bet on the wrong final move. That is, for example, a player bets $100 on a "sink" scenario. After each move, the player receives inchoately as his or her "cargo" (i.e., $10 from the bank assuming similar in fashion to the odds on "sink" are 10 to 1). After the first move then, the player has in cargo $110. After the second move, $120, and so on until the game piece lands on an absorbent point ending the game or round. If the absorbent point is a "sink" point, and it lands on the point after six moves, the player receives his original $100 back, plus the $60 accumulated with it in his cargo.

If, on the other hand, the absorbent point was a "safe" point, then the player bet wrong and he loses his $100 bet, along with the $60 that the bank had placed in his cargo. Since the player cannot leave a round before the game piece lands on an absorbent point, the $10 placed by the bank in the player's cargo after each move is inchoate, since the player's right to this $10 cargo is contingent on the game piece eventually landing on the type of absorbent point the player bet on.

Note that the odds can be computed and players can leave early, obviously only receiving a fraction of the wager and cargo. Early out can be a feature of any of these games, but from a marketing standpoint, these might be disallowed. Additionally, normal bets can also be placed such that initial dollar amount is placed and if an event occurs, odds are paid. Also, a duration bet or "swim" bet is possible. This is a wager on how long or how many steps of the game or series of rounds take place. Furthermore, one-time or proposition bets can be placed, such as the next roll of dice is northeast. Place bets on individual absorbing or non-absorbing states can be wagered. Wagers can be made that cover entering specific state(s) prior to entering other specific state(s). Finally, combinations of bets (such as a group of absorbing states being chosen) can be made. Thus, nonabsorbent points may also be used to determine winning or losing positions as well, such that a wager may be made and resolved even though the game or round has not been completed.

The inchoate cargo can excite, tempt, and entice a player to bet more and become involved in the game. In those embodiments where the players are operating the random number generator, typically in sequence like in the game of craps, the players will tend to enjoy the game like a group activity. Thus, these embodiments combine the best of craps—the excitement and group-wise feel of craps—with the best that a slot machine has to offer—rules that are simple enough to catch on after watching just a couple rounds. Therefore, a prospective player may not be intimidated by a complex table of odds and betting options. Rather, the player is enticed to play and wage bets under a relatively simple set of rules and odds.

In various embodiments, the game can be designed to reduce transactional costs as the game involves less complicated rules, fewer points for placing bets, and the odds can be adjusted to favor the casino. In contrast to craps, various embodiments of the game allows for the excitement and group activity of craps, a more inviting set of rules than craps, resulting in more players, less training and oversight required for the casino personnel, and markedly better odds in favor of the house.

Embodiments of the board game and associated methods are illustrated by the following examples. These examples are provided for exemplification and are not included to be limiting.

EXAMPLE 1

Seven Seas, Safe Edge, Walk the Plank, or the Like

Seven Seas or Treasure Island is another embodiment of the present invention, that has a table game design for play at home or in casinos worldwide. In one embodiment, the game is played on a standard Blackjack or Craps table. In another embodiment, the table may be shaped like a ship, barge, or the like. In the ship-like embodiments, sections of the Craps table may have names based on Seven Seas, such as aft, rear and starboard sections. In the various game embodiments, the house has between a 0-25% advantage over the player, depending upon the variant used (although odds outside this range can be engineered).

In one embodiment, the Seven Seas game uses a standard 52-card deck of playing cards (which leads to randomization without replacement) in the 3% version. In another embodiment, the game uses two Craps' dice (which leads to randomization with replacement) in the 7% version with equal betting options. Note that both the 52-card deck and dice versions can be adjusted to any odds the house wishes. Potentially useful are circular buttons as those used in Craps, which are additional props that ease play, but ultimately have no probabilistic influence on the games outcome. An automatic shuffler can be used if desired or dealer can employ manual riffle shuffle. Furthermore, with the standard playing card version, multiple decks such as, but not limited to, Blackjack with 2, 4, 6, 8 or more decks can be employed.

In those game embodiments such as Safe Edge using randomization with replacement, players may enter the game at any time during play. Due to the unique Markov property of this game variant, Chapman-Kolmogorov Equations can be employed to allow any place bets involving transitions conditionally and unconditionally from state A to state B. In contrast, the games using randomization without replacement use an ad hoc time-consuming method for calculations of odds for similar wagers.

Since the casino places tokens on the table in plain view for the player in a form of trust, a temptation and enticement for the player is created within normal game play. The temptation or enticement is enhanced as the casino continues to put more and more chips on hold, which amass into a small treasure trove for the player at each turn of the card or roll of the die. This is contrary to the reverse psychology and disincentive employed in the table games Let-It-Ride and Blackjack. In Let-It-Ride, the player puts three sets of equal sized bets on the table. As the first two dealer cards are revealed, the player in turn can take back each of two of his bets. In Blackjack, the player can surrender half his bet once the two initial cards are dealt and are considered out of play for the rest of the hand. In both Let-It-Ride and Blackjack, the normal game play leads to a disincentive by offering the player a chance to question their original bet and recoup a portion of it.

Similar to Craps, a palpable energy permeates game play when a disproportionate amount of players bet together in that their fates are inextricable. In Craps, team play is exercised often as many players choose to play the Pass Line and go against the house. A similar situation would occur in Seven Seas games where players bet against the house with Safe play or in games where players bet with the house with Sink play.

Also similar to Craps, the embodiments of the Seven Seas games variants have suspense naturally built-in. Whereas Craps uses the concept of the point that eventually leads to making the point or crapping out, the game embodiments describe herein has the widget either making a "safe return" or "sinking".

Craps intimidates many people. However, the Craps version of Seven Seas is easier than craps to understand, and since it is played on a Craps table, it acts as a portal to playing Craps. It is effectively a gateway game. Furthermore, since Craps has little room for the casino to adjust odds and is considered to be one of the closest to fair games played, with the odds adjustable nature of Safe Edge (Seven Sea's Craps version), gambling establishments will be offered a plethora of opportunities to cater to their clientele and to increase business.

In the embodiment using 52-card/3% version, a game piece starts from a center position. In one embodiment, a small model boat starts from an island in the center of a model ocean. The dealer cries, "All Aboard," or any other request for players to place their bets. Each turn the game piece will move randomly in one of four directions (north, south, east, west). As the boat moves, money is placed into the cargo holds on the boat. The game ends when the boat docks safely back at its original starting point (and the dealer cries, "Land Ho") or wanders beyond the perimeter of the calm waters region (which means it sinks or is lost at sea). In one embodiment, players can play one of two ways: safe-trader and sink-trader. In another embodiment, variant or alternate pay table known as Super Seven Seas will have up to two additional betting options: sink-emperor and safe-emperor.

Method for 52-Card/3% Version of Seven Seas

Start a. The Player takes a seat at one of seven positions at a standard Blackjack table.

b. Player uses chips or tokens in order to make bets, exchanging cash for chips with the dealer. (Note that in some casinos cash can be used on the betting table.)

c. Dealer cries "All Aboard" or requests players to place their bets.

d. Player places individual place bets in one or both of the two betting circles such that each individual bet is between the table's minimum and maximum set by the casino.

e. Safe bet circle pays if the widget returns safely to its starting point.

f. Sink bet circle pays if the widget makes it to the edge of the game board.

g. Dealer shuffles a standard 52-card deck of playing cards manually or automatically.

h. A widget is placed in the center (0,0) of a two-dimensional 4×4 diamond-shaped board, as shown in FIG. 4, with integer coordinates whose sum of the absolute value of each ordinate for each ordered pair is less than or equal to four. The widget will move from coordinate to coordinate remaining always on the game board. Each coordinate on the game board is referred to as a state, such that it determines the location of the widget at all times.

Determine Next State with Transition Probabilities a. The top card from the deck is placed face-up onto the discard pile.

b. If the card is a spade, then the widget is moved relative to the player's perspective upward or northward, which is equivalent to adding one to the range. For example, if a spade is drawn on the first turn, the dealer moves the widget from the origin (0,0) to (0,1).

c. If the card is a heart, then the widget is moved relative to the player's perspective toward the right or east, which is equivalent to adding one to the domain. Hence, the transition is from state (x, y) to (x+1, y). For example, if a heart is drawn on the first turn, the dealer moves the widget from the origin (0,0) to (1,0).

d. If the card is a club, then the widget is moved relative to the player's perspective downward or southward, which is equivalent to subtracting one from the range. Hence, the transition is from state (x, y) to (x, y−1). For example, if a club is drawn on the first turn, the dealer moves the widget from the origin (0,0) to (0, −1).

e. If the card is a diamond, then the widget is moved relative to the player's perspective toward the left or west, which is equivalent to subtracting one from the domain. Hence, the transition is from state (x, y) to (x−1, y). For example, if a diamond is drawn on the first turn, the dealer moves the widget from the origin (0,0) to (−1,0).

Determine if State is Nonabsorbent

Absorbing states are the origin and the outer edges of the game board. Nonabsorbent states are not absorbing states. When the widget is moved to a non-absorbent state, the various inchoate cargo is added to each player's cargo bin and the above steps are repeated. For example, the dealer places house chips equal to 1:11 rounded down if the player has a bet in the Sink circle, and house chips equal to 3:10 rounded down if the player has a bet in the Safe circle.

When the widget lands on an absorbent state, then the game's round is over and the dealer collects all chips on the playing tables that are losing bets. Losing players are those who bet the Sink circle when the widget returns to the origin or those who bet the Safe circle when the widget reaches the edge of the game board.

For the winning player, the dealer gives all chips on the playing table that are winning bets to the respective player(s) including any additional house chips owed each winner under the above rules for the last move of the widget that landed it on an absorbent point. For example, the dealer places house chips equal to 1:11 rounded down if the player has a bet in the Sink circle, or places house chips equal to 3:10 rounded down if the player has a bet in the Safe circle. Winning bets are those that bet the Sink circle when the widget reaches the edge of the game board and those that bet the Safe circle when the widget returns to the safe point at the origin of the game board.

A round of Seven Seas is now complete. In order to continue playing Seven Seas, the dealer and players start with step 1 again.

As those skilled in the art will appreciate, the suits of the card (clubs, hearts, diamonds, spades) may correspond to different directions such as, but not limited to, up, down, left, right, north, south, east, and west. Alternatively, the board may be a 3×3, 5×5, or greater matrix as shown in FIG. 5.

EXAMPLE 2

2-dice/7% Safe Edge Version for Craps

In another example, a small numbered disk for the player's position starts from the center of a diamond grid such as that used in Seven Seas, which is laid out in formulation one as shown in FIG. 3 (in the equivalent second formulation the game board is a square as shown in FIG. 2). The dealer says, "Place your bets," which is a request for players to place their bets before the next roll of the dice. Each turn the disk will move randomly in one of four directions (north, south, east, west). As the disk moves, money is placed into a holding area. The game ends when the disk safely returns to its original starting point or wanders to the edge of the game board. Players can play one of two ways: Safe and Edge.

As those skilled in the art will appreciate, variant or alternate pay tables can be generated by varying the values and types of bets as well as the fixed transition probabilities. For expository ease and comparison, the Safe Edge embodiment described herein demonstrated in this application is similar to the Seven Seas embodiment described herein with regards to pay ratios and uses the symmetric case for the four transition probabilities set equal to one-fourth. Because transition probabilities are fixed, the game exhibits the Markov property of no memory.

Method—2-Dice/7% Safe Edge Version for Craps i. Formulation One—Diamond

Start a. Player takes a seat at one of any open positions at a standard Craps table b. Player uses chips or tokens in order to make bets, exchanging cash for chips with the dealer; note that in some casinos cash can be used on the betting table c. Dealer requests players to place their bets d. Player places individual place bets at any time prior to any roll in one or both of the two betting circles such that each individual bet is between the table's minimum and maximum set by the casino e. Safe bet pays if the widget returns safely to its starting point f. Edge bet pays if the widget makes it to the edge of the game board g. Dealer present five dice with a croupier to the roller h. Roller selects two dice from the set of five i. A widget (e.g., a small numbered disk) is placed in the center (0,0) of a two-dimensional 4×4 diamond-shaped board with integer coordinates whose sum of the absolute value of each ordinate for each ordered pair is less than or equal to four. Hence, ordered pair (3, −1) has a sum of the absolute value of its ordinates equal to four (|3|+|−1|) and is within the game board, whereas ordered pair (−2, 3) has a sum of the absolute value of its ordinates equal to five (|−2|+|3|) and is outside the game board. The widget will move from coordinate to coordinate remaining always on the game board. Each coordinate on the game board is referred to as a state, such that it determines the location of the widget at all times.

Determine Next State with Transition Probabilities a. The roller throws the dice making sure one careens off the back wall b. If the roll is a 7 or 10, then the widget is moved relative to the player's perspective upward or northward, which is equivalent to adding one to the range.

c. If the roll is a 5 or 6, then the widget is moved relative to the player's perspective toward the right or east, which is equivalent to adding one to the domain.

d. If the roll is a 2, 3, 4, 11 or 12, then the widget is moved relative to the player's perspective downward or southward, which is equivalent to subtracting one from the range.

e. If the roll is an 8 or 9, then the widget is moved relative to the player's perspective toward the left or west, which is equivalent to subtracting one from the domain.

Determine if State is Nonabsorbent a. Absorbing states are the origin and the outer edges of the game board. Nonabsorbent states are not absorbing states and the play of the game follows the steps described above.

ii. Formulation Two—Square (45° Rotation of Diamond Game Board)

Start a. Player takes a seat at one of any open positions at a standard Craps table b. Player uses chips or tokens in order to make bets, exchanging cash for chips with the dealer; note that in some casinos cash can be used on the betting table c. Dealer requests players to place their bets d. Player places individual place bets at any time prior to any roll in one or both of the two betting circles such that each individual bet is between the table's minimum and maximum set by the casino e. Safe bet pays if the widget returns safely to its starting point f. Edge bet pays if the widget makes it to the edge of the game board g. Dealer present five dice with a croupier to the roller h. Roller selects two dice of different color, say blue and red from the set of five i. A widget (e.g., a small numbered disk) is placed at the origin (a valid state) of a two-dimensional 4×4 square board with integer coordinates whose sum of each ordinate for each ordered pair is even and the absolute value of each ordinate for each ordered pair is less than or equal to four. Hence, ordered pair (3, −1) has a sum of two which is even and the absolute value of its ordinates equal to three and one which are both less than four and is within the game board, whereas ordered pair (−2, 3) has a sum of one which is odd even though the absolute value of its ordinates equal to two and three and is outside the game board. The widget will move from coordinate to coordinate remaining always on the game board. Each coordinate on the game board is referred to as a state, such that it determines the location of the widget at all times. The game board consists of 41 states.

Determine Next State with Transition Probabilities

The roller throws the dice making sure one careens off the back wall. If the blue die roll is even, then the widget is moved relative to the player's perspective upward or northward, which is equivalent to adding one to the range. If the red die roll is even, then the widget is moved relative to the player's perspective toward the right or east, which is equivalent to adding one to the domain. If the blue die roll is odd, then the widget is moved relative to the player's perspective downward or southward, which is equivalent to subtracting one from the range. If the red die roll is odd, then the widget is moved relative to the player's perspective toward the left or west, which is equivalent to subtracting one from the domain.

Determine if State is Nonabsorbent

Absorbing states are the origin and the outer edges of the game board. Nonabsorbent states are not absorbing states. They are the complement of the absorbent states and generally surround the absorbent states.

The dealer gives all chips on the playing table that are winning bets to the respective winning player(s). Winning bets are those that bet Edge when the widget reaches the edge of the game board and those that bet Safe when the widget returns to the origin. A round of Safe Edge is now complete. In order to play another round of Safe Edge, the dealer and players start with step 1 again.

EXAMPLE 3

Black Hole and Escape Velocity

Black Hole and Escape Velocity may be science fiction based. Transition probabilities are fixed as in Safe Edge, but vary depending on distance from the origin. Gravitational pull by heavenly bodies is modeled by giving larger transitional probabilities to the widget when closer to the center of gravity. A Roulette wheel is an exemplary mechanism to impart randomization.

Black Hole involves an object such as a light ray or spaceship, which starts at the edge of a two- or three-dimensional game board. If using the game board from Seven Seas and/or Safe Edge, the game piece would start at one of the absorbing states but not the origin. The goal of the game would be to aid the object to the center of the black hole and exit the other side of it in order to enter another dimension. Players would either (i) work together as a team or (ii) against one another in a race to finish first or (iii) against one another such that one tries to obtain the goal while the other wins by preventing the first player from their goal.

Escape Velocity involves an object such as a spaceship, which starts at the center of a two- or three-dimensional game board, similarly to the widget in Seven Seas and Safe Edge. The goal of the game would be to escape the gravitational pull of the heavenly body the space ship is currently landed. Players would either (i) work together as a team such as NASA does during joint national space missions or (ii) against one another in a race to be the first in the space race as USA and USSR did historically or (iii) against one another such that one tries to obtain the goal while the other wins by preventing the first player from their goal, such as an enemy shooting surface-to-air missiles in an attempt to shoot down the spaceship.

EXAMPLE 4

Financial Options Markets—European Call and Put Options

The Safe and Sink/Edge bets from Example 2 mimic long positions in European call and put options, respectively. Super Seven Seas with the additional two bets, Sink-Emperor and Safe-Emperor complete the quartet of standard European options on the CBOE by mimicking short positions in calls and puts, respectively. Emperor refers to the player and house switching positions, such that now the player places money inchoate for the house thus acting as an emperor of sorts.

Accordingly, the creation of an artificial financial options market in the form of a gambling game would allow everyone to mimic dabbling in the options market. Thus, the gambler would be able to employ gambling strategies in the same way an options trader employs trading strategies, such as spreads, straddles, and strangles. The typical options trading strategy involving buying a call and a put with different exercise prices, known as a bottom vertical combination, can be closely mimicked by a player placing both Safe and Sink bets at a Seven Seas table. Of further interest to this gambling strategy is the similar nature of the naming and playing convention with the parallel to the bottom vertical combination option trading strategy: the options trader takes a long position in both a call and a put option and the gambler hopes regardless of the final outcome of a round of play that a long roll is achieved.

EXAMPLE 5

Piggyback and Random Walk Applications

Any finite-state, finite-dimension random walk is covered. Starting position need not be absorbing. Also, individual random walks can be strung together in series or in parallel. Perpendicular boards can also be arranged, which are the same as parallel mathematically, but easily represented for human consumption in perpendicular fashion. Three figures have been added in order to furnish specific examples. The term piggyback is utilized to show that this game sits atop another game, roulette, such that the regular game of roulette is unaffected during play of piggyback.

Figure 6:
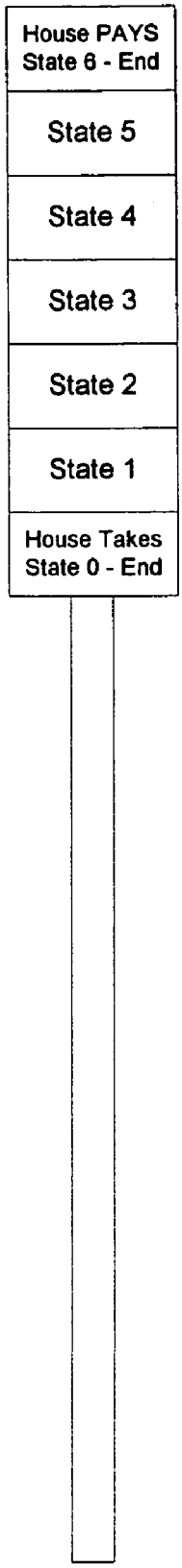
FIG. 6 is a top view of another embodiment of the game board.

FIG. 6 shows a random walk with seven states (0 and 6 being absorbent) in one-dimension where a roulette ball's color determines its next placement (green goes against player's wager). States 1, 2, 3, 4 and 5 are nonabsorbent and are possible starting positions.

Figure 7:
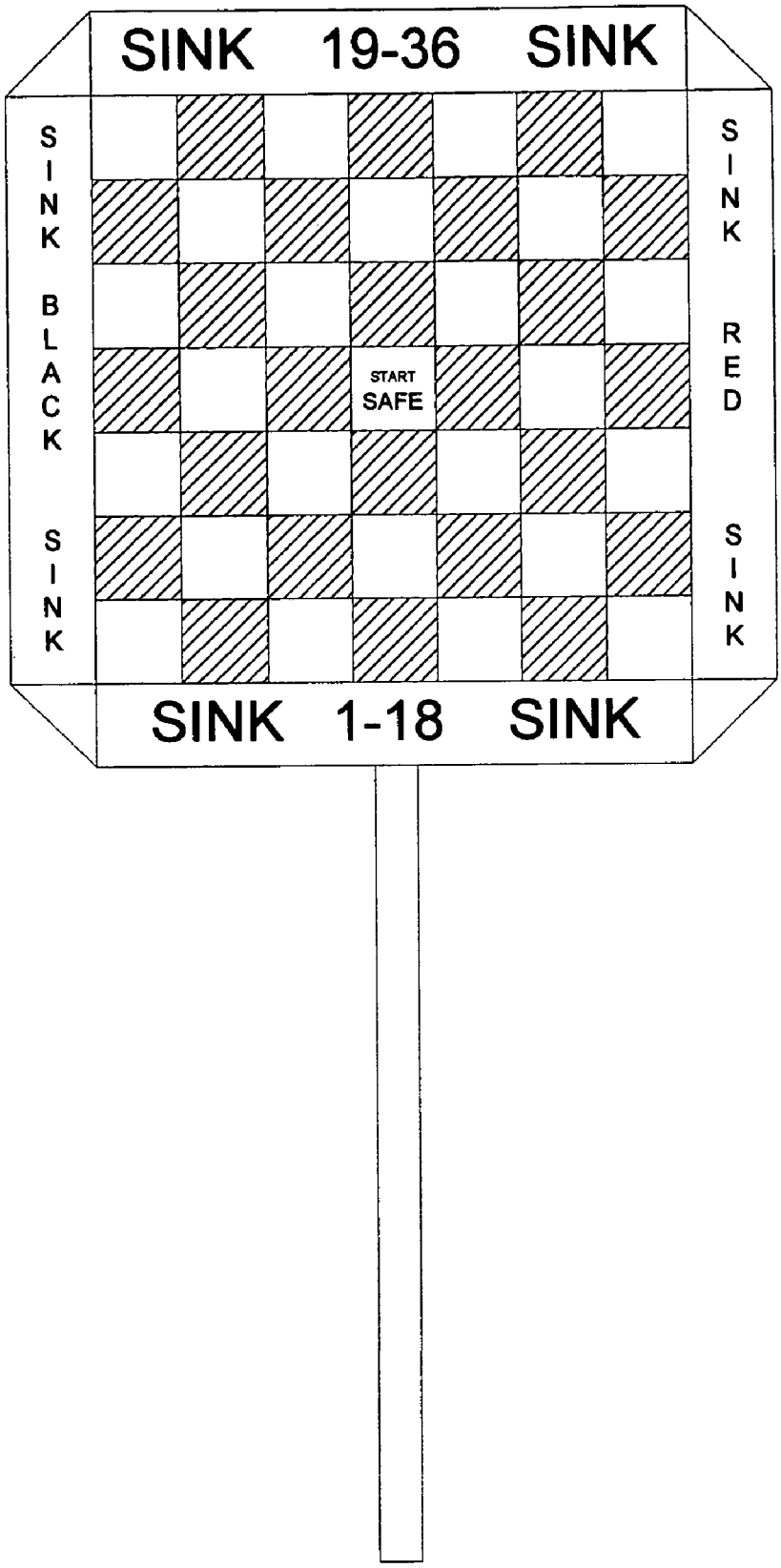
FIG. 7 is a top view of another embodiment of the game board.

FIG. 7 shows two perpendicular (in parallel) one-dimensional random walks with nine states (0 and 8 being absorbent, as well as the coordinates 0-0 being absorbent) where a roulette ball's color and number determines its next placement (green 0 goes towards black, green 00 goes towards red). This is isomorphic (mathematically the same) to Example 2: 2-dice/7% Safe Edge Version for Craps.

Figure 8:
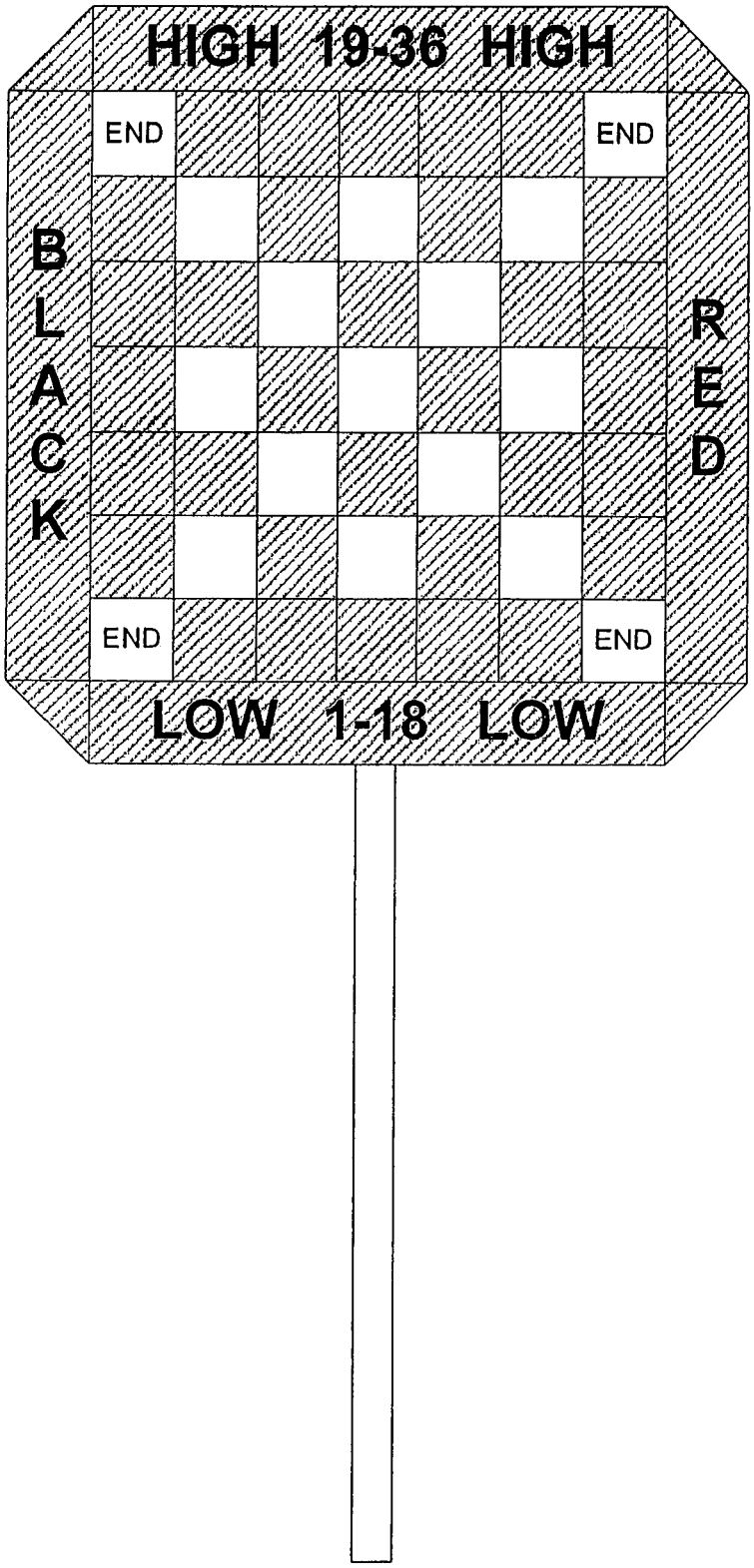
FIG. 8 is a top view of another embodiment of the game board.

FIG. 8 shows two perpendicular (in parallel) one-dimensional random walks with seven states (coordinates 0-0, 0-6, 6-0, 6-6 are absorbent) where a roulette ball's color and number determines its next placement (green 0 goes towards black, green 00 goes towards red).

The various games referred to as Safe Edge, Black Hole, Escape Velocity, and Piggyback are examples of Markov chains since the conditional distribution of future state given the past states and present state is independent of the past states and depends only on the present state. This is achieved due to the randomization with replacement created by rolling dice, flipping coins or rolling a roulette wheel.

The games referred to as Seven Seas or Treasure Island is not a Markov chain, although it is a form the inventor assumes for a random walk. In effect, the games take the form of a pseudo-random walk because subsequent transitions are not independent as that term is defined in the field of probabilities and stochastic science.

If the edges of the Safe Edge game are removed, by extending the edges infinitely in all directions, you get a Markov Chain known as a symmetric random walk. If you further collapse one dimension onto itself, so that transition probabilities are one-half, then we would have a symmetric random walk in one dimension, which is a standard topic in a stochastic processes course. In the one- and two-dimensional symmetric random walk all states in the board space are recurrent. Thus for example, when starting at the origin, a random walk in one and two dimensions revisits the origin infinitely often. Hence the probability of return to the origin is one. Realize in three dimensions that each state can transition to six directions (like on the face of a die) or to eight directions (as through the corners of a die). We can extend the symmetric random walk to four and higher dimensions. In the four-dimension case, one could imagine 4 fair coins are tossed to find the vector to be added to the present coordinates. In the unbounded (where the board space is infinite) symmetrically Markovian (transition probabilities are all equal) case in three and higher dimensions all states in the board space are transient. A transient state is a state that is finitely visited or stated another way has probability of revisiting the state less than unity. Informatively, the probability of returning to the origin is roughly 0.35 for the 6-direction three-dimension random walk, 0.239 for the 8-direction three-dimension random walk, and 0.105 for the 16-direction four-dimension random walk.

The logical random mechanism of flipping four fair coins each labeled with a dimension that was used in the four-dimension symmetric random walk case, lends itself to a nice interpretation in all other dimension symmetric random walks. Namely, in the two-dimension symmetric random walk, one could use two fair coins to find the vector to be added to the present coordinates. Any 50-50% random mechanism uniquely labeled for the x-axis and y-axis would suffice, such as a fair pair of evenly sided dice with half the sides on one die labeled N (north) and S (south), and another evenly sided die labeled E (east) and W (west). Two urns with equal amounts of balls of the relevant direction would work equally well. Furthermore, any evenly fair and divisible random mechanism labeled with the direction vector would suffice. For example, a four-sided die with one face for each of the directions NE (northeast), NW (northwest), SE (southeast) and SW (southwest), an eight-sided die with two faces for each of the previously mentioned directions, a twelve-sided die with three faces for each of the previously mentioned directions, or a dodecahedron with five faces for each of the previously mentioned directions. The compass approach lends itself towards using the roulette wheel with quadrants parceled out on the wheel according to the directions NE, NW, SE and SW, which is in line with a popular gambling strategy for Roulette where players bet all the numbers in an arc of the wheel. The directional names N, S, E and W are immaterial. They could have equally been labeled U (up), D (down), L (left) and R (right), or any other useful modeling nomenclature either alphanumeric or symbolic.

While the present invention has been described with regards to particular embodiments, it is recognized that additional variations of the present invention may be devised without departing from the inventive concept.

What is claimed is:

1. A method of playing a game, comprising:

(a) beginning the game with a player's game piece operatively on a starting non-absorbent point in a row of at least two non-absorbent points, said row bounded on each end by an absorbent point;

(b) receiving at least one wager that the game piece will be moved to a predetermined first absorbent point before being moved to a predetermined second absorbent point;

(c) observing an event that dictates to which point the game piece must be moved, wherein a first outcome of the observed event causes said dictated point to be on one side of the point on which the game piece is currently operatively on, and wherein a second outcome of the observed event causes the dictated point to be on the other side of said current operative point;

(d) determining whether the dictated point is a non-absorbent point, the first absorbent point, or the second absorbent point;

(e) calculating an inchoate cargo in relation to the player's wager if the dictated point is a non-absorbent point;

(f) moving the game piece to said dictated point and repeating at least steps (c) and (e) if the dictated point is a non-absorbent point, such that said inchoate cargo calculation changes during play of the game;

(g) awarding the player the at least one wager if the dictated point is the first absorbent point; and (h) denying the player the at least one wager if the dictated point is the second absorbent point.

2. The method of claim 1 further comprising selecting a starting non-absorbent point from more than one available starting non-absorbent points.

3. The method of claim 1 wherein the starting non-absorbent point becomes a first or second absorbent point after the first move of the game.

4. The method of claim 1 wherein the observed event involves one or more decks of cards, one or more dice, one or more coins, a roulette wheel, a sporting event, a horse race, a meteorological event, or a computer.

5. A method of playing a game, comprising:

(a) beginning the game with a player's game piece operatively on a starting non-absorbent point on a multi-dimensional game board comprising a plurality of non-absorbent points surrounded by a plurality of absorbent points;

(b) receiving at least one wager that the game piece will be moved to a first absorbent point before being moved to a second absorbent point;

(c) observing one or more events that dictates which adjacent point the game piece must be moved to, said one or more events providing for at least a first outcome and a second outcome, wherein the first outcome dictates a first dictated adjacent point to which the game piece must be moved and the second outcome dictates a second dictated adjacent point to which the game piece must be moved, and wherein the first and second dictated adjacent points are in generally opposite directions from the point on which the game piece is currently operatively on;

(d) determining whether said dictated adjacent point is a non-absorbent point, a first absorbent point, or a second absorbent point;

(e) calculating an inchoate cargo in relation to the player's wager if the dictated point is a non-absorbent point;

(f) moving the game piece to said dictated adjacent point and repeating at least steps (c) and (e) if the dictated adjacent point is a non-absorbent point, such that said inchoate cargo calculation changes during play of the game;

(g) awarding the player the at least one wager if the dictated adjacent point is a first absorbent point; and (h) denying the player the at least one wager if the dictated adjacent point is a second absorbent point.

6. The method of claim 5 wherein the observed event involves a first dice and a second dice, wherein half of the faces on the first dice dictate moving the game piece in a first direction and the other half of the faces on the first dice dictate moving the game piece in a second direction opposite said first direction, wherein half of the faces on the second dice dictate moving the game piece in a third direction and the other half of the faces on the second dice dictate moving the game piece in a fourth direction opposite said third direction.

7. The method of claim 6 wherein the first direction is oblique to said third direction.

8. The method of claim 5 wherein the non-absorbent points are oriented in a north, south, east, and west orientation to one another or a northwest, northeast, southwest, or southeast orientation to one another.

9. The method of claim 5 wherein one or more absorbent points are interspersed among the non-absorbent points at predetermined locations in addition to the plurality of absorbent points that surround the non-absorbent points.

10. The method of claim 5 the wager involves a selection of a particular one or more first absorbent points from more than one first absorbent points.

11. The method of claim 5 wherein the wager involves a selection of a particular one or more second absorbent points from more than one second absorbent points.

12. A method of playing a game, comprising:

(a) receiving at least one wager that a game piece will be moved to a first absorbent point before being moved to a second absorbent point, said wager being placed while said game piece is on a non-absorbent point that is adjacent to at least one other non-absorbent point;

(b) observing one or more events that dictates to which point the game piece must be moved, said one or more events providing for at least a first outcome and a second outcome, wherein the first outcome dictates a first dictated point to which the game piece must be moved and the second outcome dictates a second dictated point to which the game piece must be moved, and wherein the first and second dictated points are in generally opposite directions from the point where the game piece is currently located;

(c) determining whether the point to which the game piece must be moved is a non-absorbent point, a first absorbent point, or a second absorbent point;

(d) calculating an inchoate cargo in relation to the player's wager if the point to which the game piece must be moved is a non-absorbent point;

(e) if the point to which the game piece must be moved is a non-absorbent point, moving the game piece to said non-absorbent point and repeating at least steps (b) and (d), such that said inchoate cargo calculation changes during play of the game;

(f) awarding the player the at least one wager if the point to which the game piece must be moved is a first absorbent point; and (g) denying the player the at least one wager if the point to which the game piece must be moved is a second absorbent point.

13. The method of claim 12 further comprising selecting a starting non-absorbent point from more than one available starting non-absorbent points.

14. The method of claim 12 the wager involves a selection of a particular one or more first absorbent points from more than one first absorbent points.

15. The method of claim 12 the wager involves a selection of a particular one or more second absorbent points from more than one second absorbent points.

16. The method of claim 12 wherein the observed event involves one or more decks of cards, one or more dice, one or more coins, a roulette wheel, a sporting event, a horse race, a meteorological event, or a computer.

17. The method of claim 12 wherein the wager is selected from a group consisting of a sink bet, a safe bet, a sink-emperor bet, a safe-emperor bet, an insurance bet, a wager based on duration, a place bet, a wager that the game-piece will enter one or more given states prior to entering one or more other states, and any combination thereof.

18. The method of claim 12 wherein the first absorbent point corresponds to a safe point or a swim point and wherein the second absorbent point corresponds to a sink point or an edge point.

19. The method of claim 12 wherein the game is played on a game board comprising one or more player stations, wherein each player station comprises one or more betting areas.

* * * * *